US005695319A

United States Patent [19]

Matsumoto et al.

[11] Patent Number: 5,695,319

[45] Date of Patent: Dec. 9, 1997

[54] GAS TURBINE

[75] Inventors: Manabu Matsumoto, Ibaraki-machi; Kazuhiko Kawaike, Hitachinaka; Takashi Ikeguchi; Shunichi Anzai, both of Hitachi; Masami Noda, Hitachinaka; Nobuaki Kizuka, Hitachinaka; Shin'ichi Higuchi, Hitachinaka; Shinya Marushima, Hitachinaka; Masaru Sekihara, Chiyoda-machi, all of Japan

[73] Assignee: Hitachi, Ltd., Tokyo, Japan

[21] Appl. No.: 627,397

[22] Filed: Apr. 4, 1996

[30] Foreign Application Priority Data

Apr. 6, 1995 [JP] Japan ..... 7-081028
Jan. 18, 1996 [JP] Japan ..... 8-006623

[51] Int. Cl.[6] ..... F04D 29/58

[52] U.S. Cl. ..... 416/95; 415/114; 415/115; 60/39.75

[58] Field of Search ..... 416/95, 96 R; 415/114, 115, 116; 60/39.75, 728

[56] References Cited

U.S. PATENT DOCUMENTS

| | | | |
|---|---|---|---|
| 2,883,151 | 4/1959 | Dolida | 416/96 R |
| 3,443,790 | 5/1969 | Buckland . | |
| 4,314,442 | 2/1982 | Rice . | |
| 4,425,079 | 1/1984 | Speak et al. | 416/95 |
| 4,484,858 | 11/1984 | Kurosawa et al. | 416/95 |
| 5,299,418 | 4/1994 | Kerrebrock | 415/114 |
| 5,318,404 | 6/1994 | Carreno et al. | 416/95 |
| 5,340,274 | 8/1994 | Cunha | 415/114 |
| 5,413,463 | 5/1995 | Chiu et al. | 416/95 |
| 5,472,313 | 12/1995 | Quinones et al. | 415/115 |

FOREIGN PATENT DOCUMENTS

| | | | |
|---|---|---|---|
| 971297 | 1/1959 | Germany | 416/95 |
| 54-13809 | 2/1979 | Japan . | |
| 206905 | 10/1985 | Japan | 415/114 |
| 17305 | 1/1987 | Japan | 416/95 |
| 3-275946 | 12/1991 | Japan . | |

OTHER PUBLICATIONS

ASME/IEEE Power Generation Conference, 1987, 87-JPGC-GT-1.

*Primary Examiner*—John T. Kwon
*Attorney, Agent, or Firm*—Fay, Sharpe, Beall, Fagan, Minnich & McKee

[57] ABSTRACT

A vapor cooled gas turbine has a cooling system including a vapor supply port and a vapor recovery port, and the cooling system is formed so that vapor from the supply port is supplied to blades through a central supply passage in a rotor and the vapor having cooled the blades is recovered from the recovery port through a recovery passage spaced outwardly from the supply passage.

14 Claims, 6 Drawing Sheets

GAS TURBINE

BACKGROUND OF THE INVENTION

The present invention relates to a gas turbine which employs vapor cooling of the type wherein blades are cooled with vapor and, more particularly, to a gas turbine in which the vapor used for cooling the blades is recovered.

A steam cooling type gas turbine is disclosed in Jt. ASME/IEEE Power Generation Conference 87-JPGC-GT-1 (1987), for instance, in which vapor used for cooling the turbine blades is recovered and returned to the plant.

The prior art, however, does not disclose about a practical device for the supply and recovery of vapor necessary for a vapor cooling type gas turbine.

SUMMARY OF THE INVENTION

An object of the present invention is to provide a structure for the supply and recovery of vapor used in a vapor cooled gas turbine, and to provide a gas turbine in which the efficiency of a plant is improved.

A gas turbine according to the present invention has a cooling system for cooling the blades, using vapor.

The gas turbine comprises a compressor for compressing air (atmosphere), a combustor for burning fuel with the compressed air by the compressor to produce combustion gas of high temperature, a turbine driven by the combustion gas from the combustor, and a system for supplying vapor into the turbine.

In the combustor, combustion gas in the range of 1350°–1650° C. is produced. The higher the combustion gas temperature, the larger the power that the turbine can output. Further, the turbine has 3 or 4 stages of combined vanes and blades.

A cooling system according to the present invention comprises a vapor supply system for supplying vapor to the blades and a vapor recovery system for recovering the vapor from the blades. The cooling system is characterized in that a recovery passage of the vapor recovery system is formed so as to be positioned at a more inner side than a supply passage of the vapor supply system. Here, the vapor means is produced by a heat recovery steam generator, etc., the composition is $H_2O$ as a main component, and it is so-called steam.

The vapor supply system according to the present invention is a vapor flow system from a vapor generator to the blades of the turbine, and a part of the vapor supply system is the supply passage. Here, the supply pasage is formed inside or in a central portion of the turbine rotor. The vapor recovery system is a vapor flow system from the blades to an apparatus for recovering the vapor to use again, such as a heat recovery steam generator or a condenser, and the recovery passage is a part of the vapor recovery system. The recovery passage is formed in a central portion of or inside the turbine rotor. The vapor supply system or the vapor recovery system can be taken as a vapor flow system from the blades to an axial end of the turbine rotor shaft.

Further, the cooling system according to the present invention has a vapor supply port formed at the rotor shaft end for supplying vapor to the blades and a vapor recovery port formed at an end of the rotor shaft. It is characterized by the vapor recovery port being formed at a portion closer to the axis of the rotor than the vapor supply port which is at an outer peripheral side of the rotor.

As mentioned above, by flowing the recovery vapor through the closer portion to the axis of the rotor than the supply vapor or the outer peripheral side of the rotor, thermal stress caused in the rotor shaft, etc. is weakened, and a stable operation of the turbine is possible.

Further, the supply passage is preferable to be formed in a cavity formed between the final stage of the rotor and a stubshaft, and in a disc joining portion at which a disc and an adjacent disc are connected. Still further, one recovery passage is preferable to be formed between the first and second discs, and particularly it is preferable to use a cavity for recovering the vapor supplied to the first and second blades.

The present invention is characterized in that the compressor rotor is cooled with vapor. The vapor is supplied through a vapor passage formed in a distant piece connecting the turbine rotor and the compressor rotor, and recovered through a vapor passage formed in a closer portion to the rotor shaft axis than the distant piece. It is possible to effectively use vapor in cooling even the compressor rotor.

Upon the recovery of the vapor having been used to cool, it is preferable to form a vapor passage for introducing (recovering) the recovery vapor into the interior of a cavity formed between discs through a spacer portion formed between discs of the rotor. Spaces in the rotor can be effectively used by recovering the vapor through that portion.

Further, the spacer portion is preferable to have a projection portion for introducing the recovery vapor into the above-mentioned vapor passage, whereby vapor can be recovered more effectively. Additionally, thermal stress is relaxed by cooling the side face of the disc with part of the vapor flowing in the supply passage.

The gas turbine according to the present invention employs a closed vapor cooling system which cools the blades with vapor and recovers the vapor. The gas turbine has 3 or 4 stages of combined vanes and blades. In the gas turbines in which combustion gas temperature is 1400° C. or more and the output 400 MW or more, the temperature of vapor supplied to the blades is made to be 250° C. or less, for example, 250°–180° C. at the vapor supply port and at the vapor recovery port, respectively, and the temperature of the vapor recovered from the blades is made to be 450° C. or less, for example, 450°–380° C., whereby the cooling system can be achieved. It is possible to change those temperatures to other temperatures, that is, the former may be 300°–230° C. and the latter 500°–430° C. The temperatures are determined taking into consideration the thermal load of a turbine and the allowable temperature of material used for blades. Further, it is determined by taking into consideration the flow rate of the vapor and the allowable temperature of material used for a rotor.

By this construction, the efficiency of the gas turbine can be raised by 5–6% and the output by 13–16%, as compared with a gas turbine employing an open cooling system. Further, the efficiency of the gas turbine can be raised by 0.8–1.2% and the output by 2–3%, compared with a gas turbine employing a conventional closed cooling system.

That is, it is preferable to provide vapor passages with 2 systems, a vapor supply system and a vapor recovery system in the interior of the rotor supporting the blades. In a gas turbine having a working gas temperature of 1400° C. or more, a difference in temperature between the supply vapor and the recovery vapor becomes 200° C. or more. Therefore, it is important to suppress the rotor temperature rise due to the recovery vapor to an allowable temperature or less and to suppress the thermal stress caused by the temperature difference to an allowable stress or less, sufficiently taking it into consideration that vapor flows in the two vapor systems are not interacted and that the rotor is a high speed rotator.

Further, it is necessary to make the compression ratio of the compressor higher in order to increase the specific output (an output per a unit fuel amount) of the gas turbine. However, when the compression ratio is made higher, the temperature of compressed air discharged rises and an outer peripheral portion of the compressor rotor is heated to exceed the allowable temperature. Therefore, cooling as in the present invention is necessary. Since the compressor rotor and the turbine rotor are connected to rotate as one piece, the compressor rotor and the turbine rotor can use commonly the vapor system to be cooled.

The present invention can provide a vapor cooling type gas turbine which is suitable for increasing the efficiency by constructing, within the rotor, vapor supply and vapor recovery passages without hindering a high speed rotator.

Further, in a combined cycle power plant of a combination of the gas turbine according to the present invention and a steam turbine, vapor for the steam turbine is generated using heat of exhaust gas from the gas turbine, and making high the temperature of the working gas of the gas turbine can increase not only the thermal efficiency of the turbine unit but also the efficiency of the entire power plant.

Therefore, the temperature of the working gas goes drastically beyond the heat resistance allowable temperature of the blades. However, the temperature of the blades can be cooled to be within the heat resistance allowable temperature by the present invention.

Since vapor is used as a coolant, it becomes unnecessary to consume extra compression power for increasing a flow rate of air as a coolant as the working gas temperature increase is required, as with use of compressed air for cooling. In addition, since low temperature air having been used for cooling is not discharged into a passage for the working gas (hereunder referred to as gas path), the working gas is not diluted whereby the temperature of the working gas is not lowered, and there is no problem that the turbine output decreases. Therefore, by using vapor in order to cool, it is possible to raise the efficiency, as compared with the gas turbine using compressed gas for combustion as coolant.

In the combined cycle power plant according to the present invention, a vapor cooling type gas turbine using vapor introduced from another system as coolant is used.

It is preferable to use superheated vapor generated using exhaust heat to avoid accumulation of impurities contained in water in the cooling passage, and the vapor has the advantage that heat transfer coefficient is large as compared with air (about 1.5 times) upon influence of viscosity factor and a Plandtl number, and a temperature rise is small when heat is loaded as compared with air (½ or less of air).

Further, in the vapor cooling type, the smaller a flow rate of the vapor supplied for cooling is, the better to raise the efficiency of the entire power plant. The vapor having been used for cooling is not wasted into the working gas, but it is recovered, whereby the efficiency is raised without influencing the working gas.

As mentioned above, in a gas turbine having a cooling system cooling the blades with vapor, a vapor supply system for supplying vapor to the blades and a vapor recovery system for recovering the vapor used for cooling are provided in the interior of the gas turbine rotor, and a recovery passage of the vapor recovery system is formed in a more inner side than a supply passage of the vapor supply system, whereby the recovery vapor of high temperature flows more to the inside than the supply vapor of low temperature, so that centrifugal stress at the central portion of the rotor is relaxed by thermal expansion.

Further, by providing a vapor supply port and a vapor recovery port at an axial end of the rotor and forming the vapor recovery port at a more central portion of the shaft than the vapor supply port, an advantage is attained that the above-mentioned recovery vapor of high temperature is easily caused to flow smoothly.

Further, in a gas turbine having a cooling system for cooling the blades with vapor, by forming a cavity between the final stage disc of the gas turbine rotor and a stubshaft and a supply passage in a portion joining between the discs to supply the vapor therethrough, the temperature of the joining portion is kept lower than the recovery vapor by the supply vapor, and thermal strain in the joining portion is reduced.

Further, a supply passage is formed in the joining portion between the discs of the gas turbine rotor to supply vapor and the vapor is recovered through the cavity formed between the first and the second stage discs, whereby the vapor is recovered and temperature rise of the disc by high temperature vapor and occurrence of thermal stress are extremely reduced.

Further, equipment to cool the compressor rotor with vapor is provided. The equipment is constructed so that the vapor is supplied through a vapor passage formed in a distant piece connecting the turbine rotor and the compressor rotor, the vapor is recovered through a vapor passage formed in a more central portion of the shaft than the distant piece, whereby the compressor rotor can be cooled by joint use of the turbine rotor and the vapor passage.

Further, in a gas turbine which cools the blades with vapor, the joining portion of the discs can be prevented from being directly exposed to the recovery vapor by interposing a spacer having a vapor passage for recovering vapor between discs of the rotor and forming the spacer in the interior of the cavity formed between the above-mentioned discs. In addition, by forming a projection for guiding vapor to be recovered by the spacer into the above-mentioned vapor passage, the heat transfer is weakened and thermal stress in the disc decreases since a recovery vapor flow is bent so as to be separated from the side face of an outer peripheral portion of the disc.

Further, in the above-mentioned gas turbine, the vapor passage is formed in the portion joining the discs, the side faces of the discs are cooled with part of the vapor flowing in the vapor passage, whereby the side faces of the discs are cooled effectively with low temperature vapor flowing out, so that temperature rise and thermal stress are decreased more effectively.

Further, according to the present invention, in a gas turbine which is constructed so that blades arranged in the outer peripheral portion of the rotor are cooled with vapor, a supply passage for supplying vapor to the blades and a recovery passage for recovering the vapor from the blades are formed in the interior of the rotor, the supply passage is formed of a hole formed in the rotor axis and cavity portion between members and the recovery passage is formed of a hole formed in a member forming the rotor in the axial direction.

Further, the above-mentioned supply passage is formed of a central hole formed in the discs and a cavity portion between members and the above-mentioned recovery passage is formed of recovery holes formed in disc joining portions or in the disc joining portions and a stubshaft.

Further, in a gas turbine constructed so that the compressor and the turbine are directly connected, and the blades of the turbine are cooled with vapor, a cooling passage is formed in the interior of the rotor of the compressor, the supply passage for supplying vapor to the blades is formed of a hole formed in the rotor axis, the cooling passage formed inside the compressor rotor and a bore portion of a distant piece connecting the compressor rotor and the turbine rotor, and the above-mentioned recovery passage is formed of a disc joining portion or a recovery hole formed in the disc joining portion and a stubshaft.

Further, in a cooling apparatus of a gas turbine which is constructed so that blades arranged in the outer peripheral portion of the rotor are cooled with vapor, a supply passage for supplying vapor to the above-mentioned blades and a recovery passage for recovering the vapor from the above-mentioned blades are provided within the rotor, the above-mentioned supply passage is formed of a hole at the rotor axis and a cavity formed between members, and the above-mentioned recovery passage is formed of a cavity portion between members.

Further, a method of cooling the blades of a gas turbine which is constructed so that the blades arranged in an outer peripheral portion of the rotor are cooled with vapor, effects vapor supply and vapor recovery to and from the blades through flow passages formed in the rotor, supplies vapor from a position of a central side of the rotor and recovers the vapor at a position to an outer peripheral side than the position of the vapor supply.

That is, in a gas turbine and a moving blade cooling apparatus which are constructed in the above-mentioned way, since the supply passage of the vapor supply system is formed inside the structural member of the rotor and the recovery passage of the vapor recovery system is formed making use of cavities between members, most of the cavities inside the rotor are filled with the supply vapor and a range of the rotor exposed to the recovery vapor is limited to the inside of the recovery hole.

As concrete effective means for realizing the above-mentioned basic conception, the supply passage is formed so as to extend from an axial end of the rotor to communicate with blades of each stage through a central hole of the discs and cavities between the discs, whereby the vapor supplied from the axial end is branched to each stage in the course of vapor flow in the central hole in the axial direction, and supplied to the blades at the outer periphery through the cavities between the discs.

By this construction, a predetermined amount of vapor is distributed and supplied to each stage. Additionally, the inner surface of the central hole and side surfaces of the discs are cooled uniformly with little thermal deformation of the members in the course of flows branched from a flow flowing in the central hole into the cavities between the discs.

On the other hand, by forming the recovery passage for vapor from the blades so as to communicate with the shaft end by boring recovery holes in the disc joining portion and the stubshaft, the recovery vapor flows into a recovery hole of the spacer after once it flows from the flow outlets of the blades into the cavities, and then the recovery vapor is recovered from the shaft end through the recovery holes of the disc joining portion and the stubshaft. That is, the range in which the rotor is exposed to the recovery vapor is limited to a narrow range of the inner surfaces of the recovery holes except for the disc side faces forming the cavities at the flow outlet portions of the blades.

A vapor supply temperature is determined through optimization of the entire plant. For example, in the case where a combustion gas temperature of the gas turbine is 1500° C., the supply temperature of vapor is better to be 250°–350° C. In this case, the recovery temperature after cooling the blades reaches 450°–550° C.

On the other hand, the heat resistance allowable temperature of rotor structural material is 400° C. in the case of usual turbine material, 500° C. or less even in the case of high strength material such as inconel of a high cost, and the recovery vapor temperature goes beyond the heat resistance temperature of the rotor. Further, in the case where the supply vapor and the recovery vapor flow in different courses in the rotor, a temperature gradient is caused in the discs due to a temperature difference between the vapor flow courses, whereby thermal stress is caused.

By constructing the supply passage and the recovery passage as mentioned above, most of the side surfaces of discs supporting the blades are covered with supply vapor of low temperature, so that the temperature of the discs can be kept at a temperature close to the temperature of the supply vapor except for the disc joining portion and the outer periphery side forming the cavities at the vapor outlet portion of the blades. Further, the side surfaces are formed in a thermally similar environment, so that the temperature gradient is gentle and generated thermal stress is small.

On the other hand, the interior of the disc joining portion is heated by the recovery vapor, however, the temperature of the interior of the disc joining portion does not go beyond the heat resistance allowable temperature of the rotor. However, in the case where there is the fear of thermal stress because the heat source is close to the cool source, the thermal stress can be reduced by providing a heat resistant material in the vapor recovery hole to reduce heat transfer from the recovery vapor to the rotor structural member.

Further, the peripheral portions of the discs forming cavities at the vapor outlet portions of the blades are cooled by the supply vapor at one side surface and by the recovery vapor at the other side surface, so that although it may be thought that thermal stress occurs because of temperature gradient in the axial direction, the resultant stress of the thermal stress and centrifugal stress is small because the centrifugal stress caused in the same portion is relatively small. Further, by changing the flow of the recovery vapor in the cavities by providing the space with a suitable shape, the thermal stress can be reduced.

As means for cooling the compressor rotor, making use of vapor for cooling the blades, a cooling passage inside the compressor rotor and a vapor supply bore and a recovery passage are formed in the distant piece, whereby the vapor flowed out of the central hole of the turbine rotor is supplied to the first stage blades after by-passing the bore of the distant piece, the cooling passage in the compressor rotor and the recovery hole in the distant piece. By this construction, the compression rotor in addition to the blades can be cooled by vapor supplied at the shaft end of the turbine rotor.

Further, in the case where a cooling passage including rotation passage in a radial and outside-oriented direction is formed in the interior of the compressor rotor, and the inlet and outlet of the cooling passage are opened to the bore of the distant piece, recirculation flows through the compressor rotor and the bore are formed in the course of flow in the cooling passage by the pumping effect of the rotation passage. The recirculation vapor is always replaced by the vapor supplied at the inside of the bore, so that the compressor rotor is cooled with the recirculation vapor of a supply temperature.

According to the present invention, the recovery of the vapor after cooling the blades is possible by solving various problems which may occur upon the recovery of high temperature. Further, the compressor rotor also can be cooled, since the temperature of a working gas can be raised further to a high temperature and a vapor cooling type gas turbine can be attained which is suitable to improve the efficiency.

Further, it is possible to reduce flow passage loss and thermal deformation and raise the efficiency without addition of specific parts or specific working.

Figure 5:
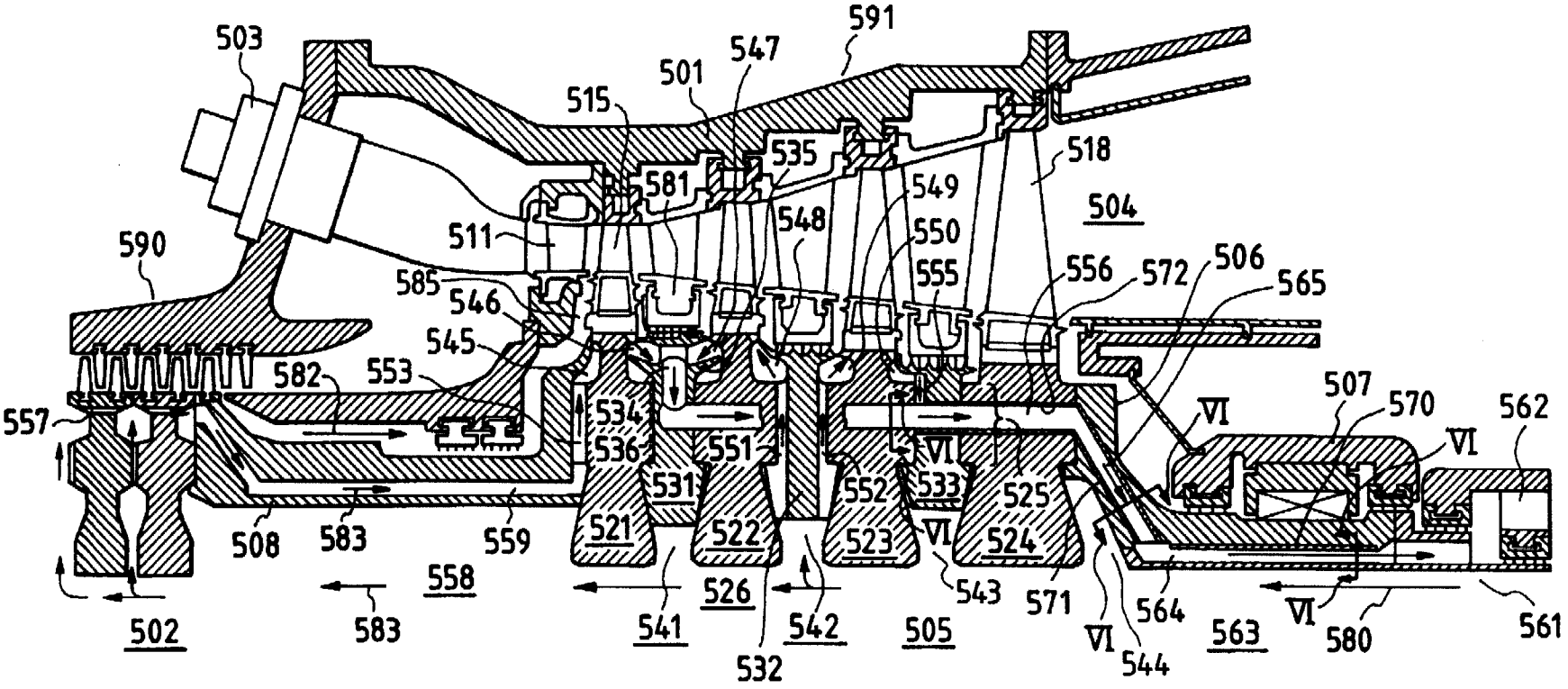
Figure 6:
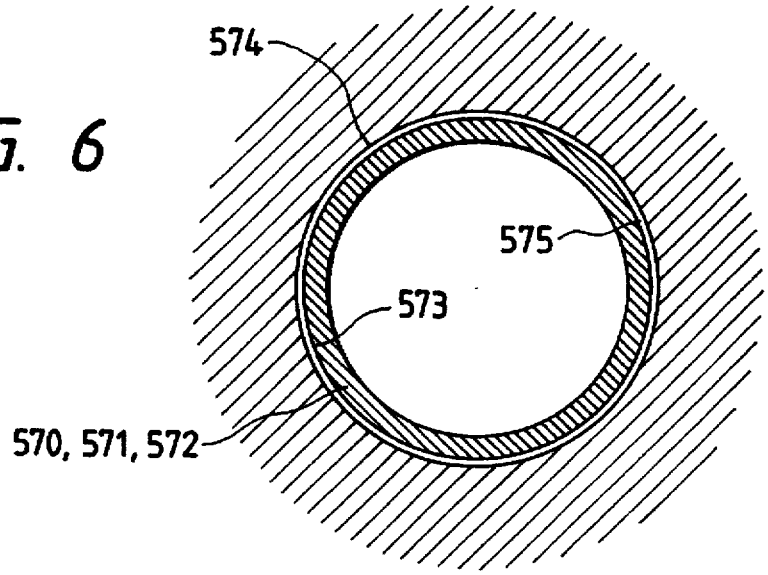
Figure 7:
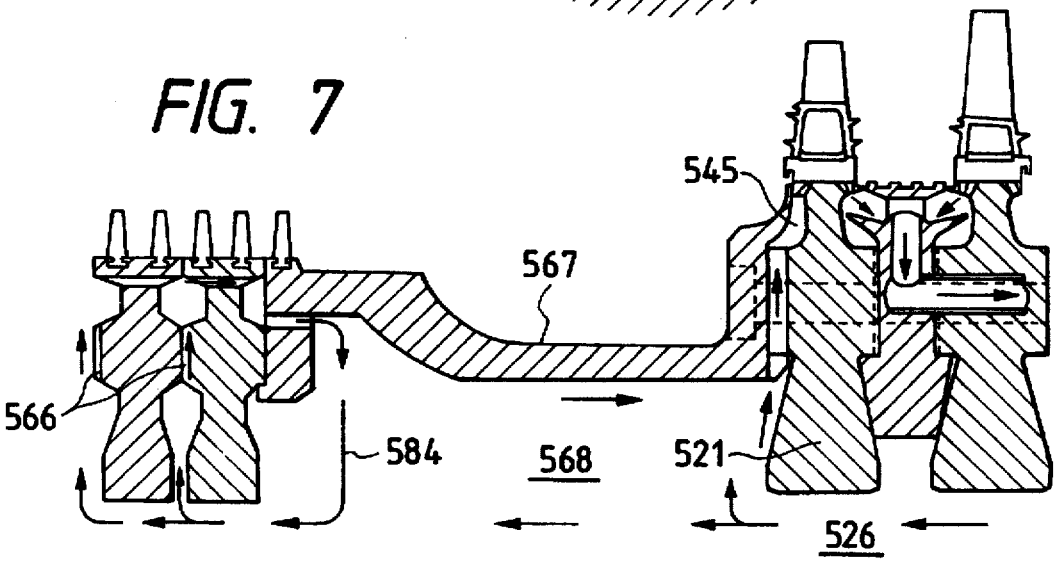
Figure 8:
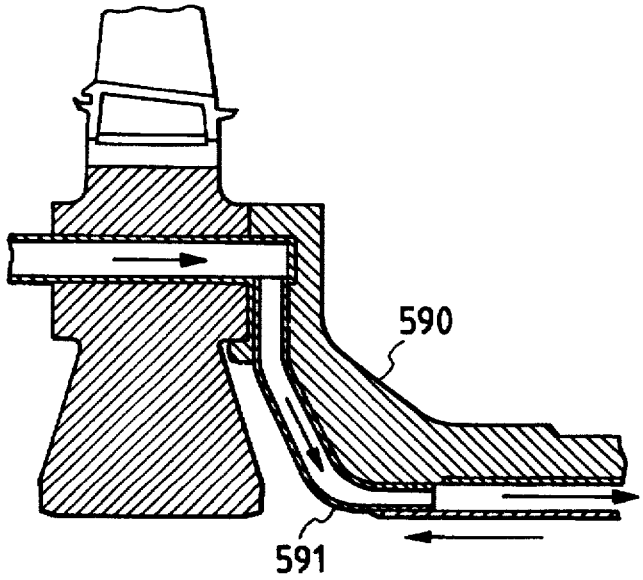

Pig. 4 is a sectional view of a vapor cooling type gas turbine of another embodiment of the present invention;

FIG. 5 is a vertical sectional view of a vapor cooling type gas turbine of another embodiment of the present invention;

FIG. 6 is a sectional view of FIG. 5, taken along a line VI—VI;

FIG. 7 is a vertical sectional view of another embodiment of a vapor cooling type gas turbine rotor according to the present invention; and FIG. 8 is a vertical sectional view of an essential part of another embodiment of a vapor cooling type gas turbine rotor according to the present invention.

DESCRIPTION OF THE PREFERRED EMBODIMENTS

An embodiment of the present invention is explained in detail hereafter.

Figure 1:
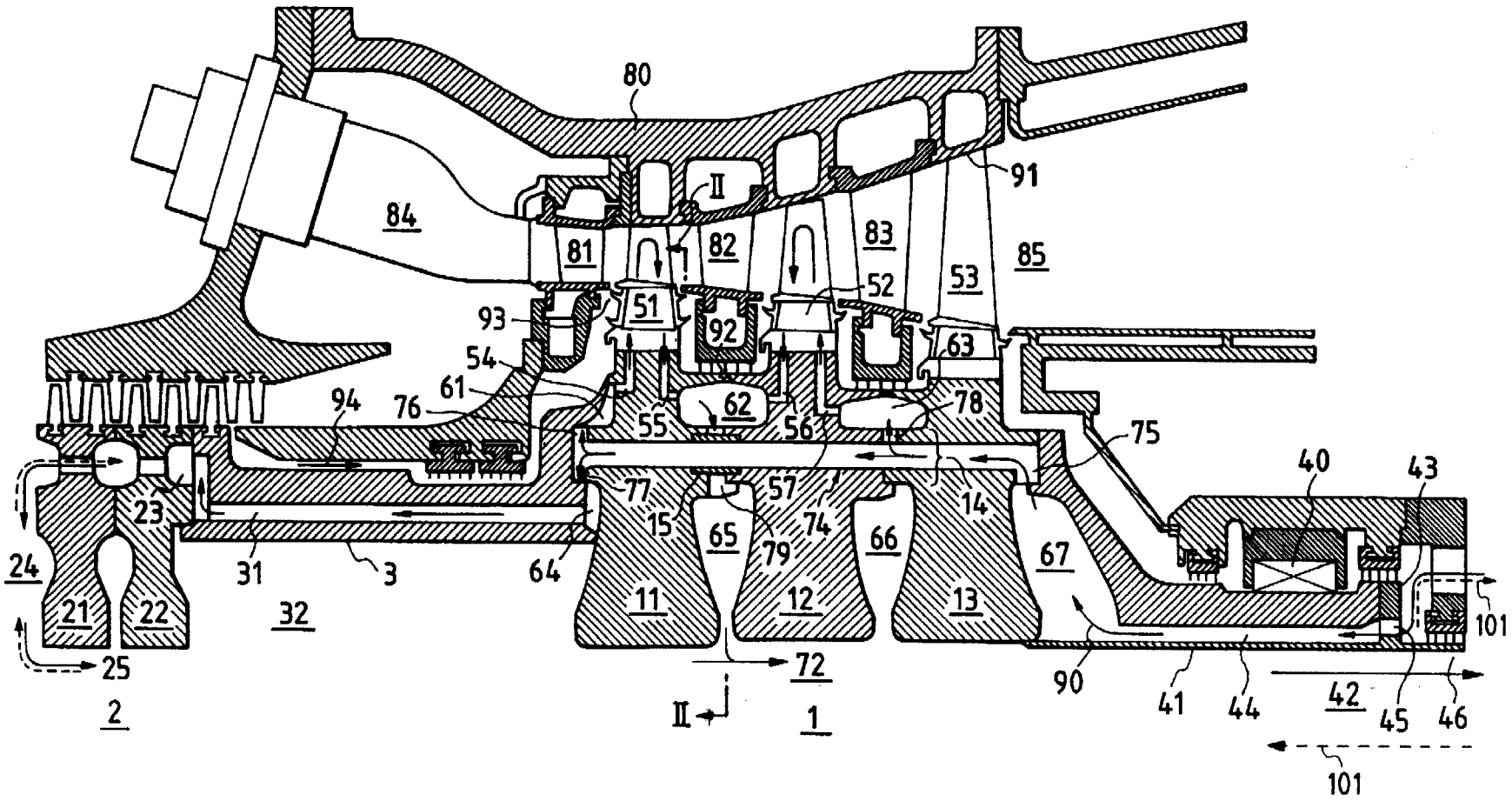
FIG. 1 is a sectional view of an upper half of a vapor cooling type gas turbine of an embodiment of the present invention.

FIG. 1 shows a sectional construction of a gas turbine upper half of an air compression type 3 stage gas turbine as an example of gas turbines concerning the present invention. In FIG. 1, the air compression type gas turbine comprises a casing 80, a compressor comprising a compressor rotor 2 and a blade row at its outer periphery, a combustor 84, a gas path 85 formed by arranging alternately vanes 81–83 and blades 51–53, a turbine rotor 1, etc.

The turbine rotor 1 comprises 3 discs 11, 12 and 13 and a stubshaft 4, and they are intimately joined at joining portions as a high speed rotator. The blades 51–53 are mounted on the outer periphery of each disc 11, 12, 13, and the turbine rotor 1 is connected to the compressor rotor 2 through a distant piece 3 and rotatably supported by a bearing 40.

In this construction, a working gas of high temperature and high pressure, generated in the combustor 84, using air compressed by the compressor 2 flows in the gas path 85 while expanding, whereby the turbine rotor is rotated to generate power.

For example, when a working gas of pressure 22–25 ata and temperature 1500° C. at the outlet of the combustor 84 is taken, output of 400 MW or more is generated by even a gas turbine having a rotor of 2.5 m outer diameter. However, a relative gas temperature at the inlet of the blades is about 1250°–1300° C. at the first stage and about 950°–1000° C. at the second stage. These temperature go far beyond an allowable temperature of the blades (usually, 850°–900° C. of blade material), and thermal loads at the first and second stage become about 1.5% (about 6000 kW) and 1.2% (5000 kW) of the output, respectively.

Further, in order to secure 22–23 ata of the pressure of a working gas, it is necessary to make the compression ratio 22 or more. In this case, the discharge temperature of the compressor becomes 500° C. Therefore, it is necessary to cool the outer peripheral portion of the compressor rotor 2 when a usual rotor material (the allowable temperature 450° C.) is used for the compressor rotor.

In order to cool the first and second stage blades and the outer peripheral portion of the compressor rotor with vapor, a plurality of supply passages 74 for supplying vapor in the axial direction are formed in the disc joining portions 14 of the turbine rotor 1 so as to pass through the three discs, and the recovery passage 72 is formed in the central portion of the rotor.

Further, between the distant piece 3 and the first stage disc 11, between the discs 11–13, and between the final stage disc 13 and the stubshaft 4, cavities 61, 62, 63 are formed at a more outer side of the disc joining portions 14, and cavities 64, 65, 66 and 67 are formed at the more inner side. A vapor passage 75 is formed at one end of the supply passage 74 at the stubshaft side so as to communicate with the cavity 67, and at the other end of the supply passage 74 and at an outer peripheral side of the distant piece 3, a vapor passage 76 and a vapor passage 77 are formed at a more outer side than the supply passage 74 and at a more inner side than the supply passage 74, respectively. Further, a vapor passage 78 communicating with the cavity 63 is formed in the disc joining portion of the second stage disc 12 and the final stage disc 13.

Further, vapor passages 54, 55 and 56, 57 communicating with the cooling passages of the blades 51, 52 are formed in the outer peripheral portion of the first stage disc 11 and the second stage disc 12 so as to open from the outer periphery to the side face. A vapor passage 79 is formed between the first stage disc and the second stage disc so that the cavities 62 and 65 are communicated each other, and a short pipe 15 is inserted so that the vapor passage 79 does not communicate with the supply passage 14 bored in the above-mentioned disc joining portion 14.

On the other hand, a guide pipe 41 is provided in the central hole bored in the stubshaft 4, and fixed by a flange 43. A vapor passage 44 is formed between the guide pipe 41 and the inner wall of the central hole, and one end of the vapor passage 44 is opened to outside of the rotor as a vapor supply port 45. Further, a vapor passage 42 is formed in the inner side of the vapor passage 44, one end of the vapor passage 42 is opened as a vapor recovery port 46 at a closer side to the axis of the shaft than the vapor supply port 45, and the other end is intimately inserted in the inner wall of the recovery passage 72.

A plurality of vapor passages 31 communicating with the cavity 77 at one end thereof and with a cavity 23 at the outer periphery side of the compressor disc 22 are formed in the distant piece 3, and a vapor passage 32 is formed at the central portion. Further, as shown by dotted lines 101 in FIG. 1, it is possible to supply vapor from the inside of the guide pipe 41 and recover it from the port 45 at the outside thereof. This case will be explained later, in detail, referring to FIG. 5.

Figure 2:
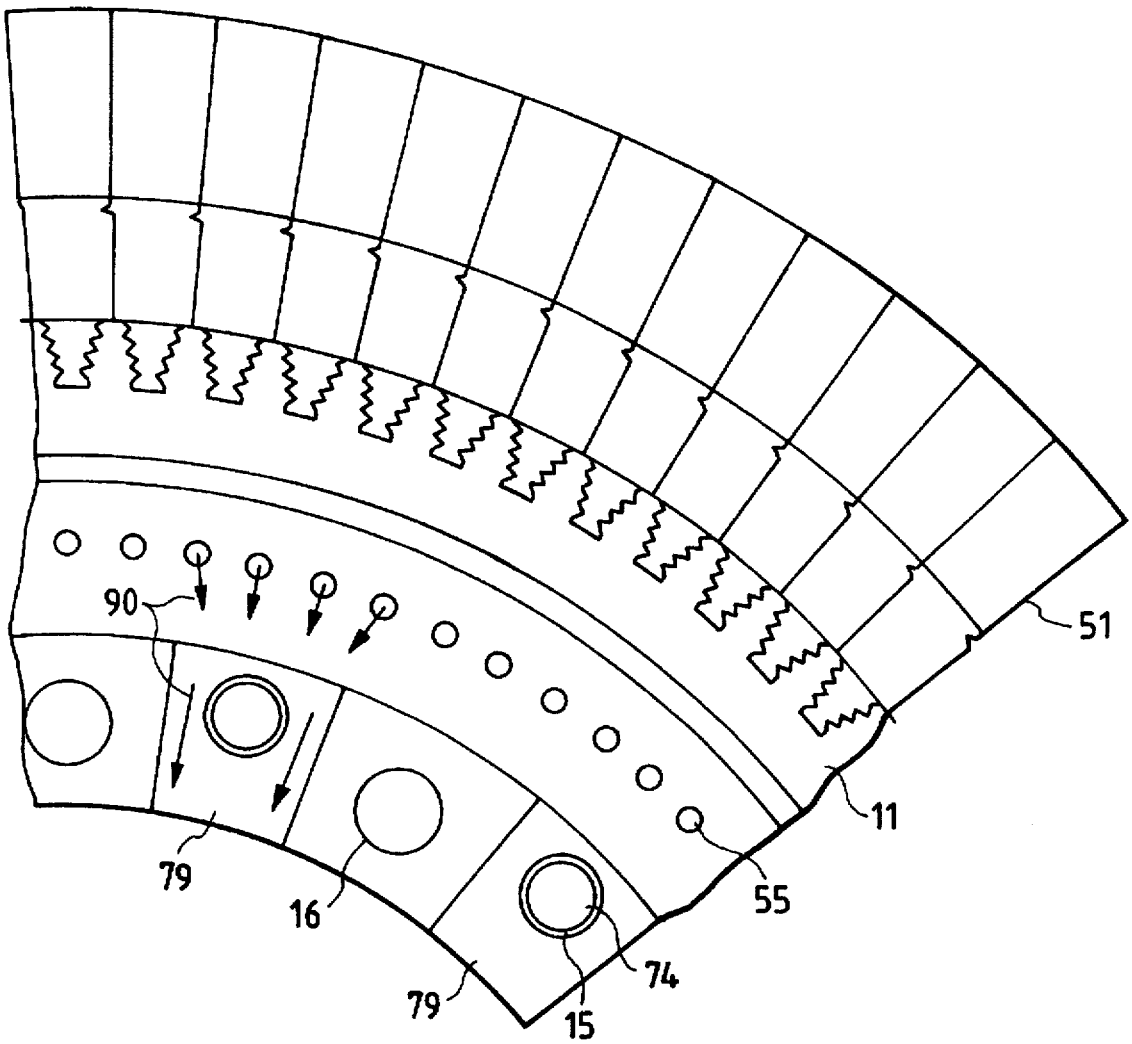
FIG. 2 is a sectional view of FIG. 1, taken along a line II—II.

FIG. 2 is a sectional view taken along a line II—II of FIG. 1. The vapor passages 55 at the outer peripheral portion of the disc 11 are bored so that the number of thereof is the same as the number of the blades 51 and the supply passages 74 and the vapor passage 76 are arranged making use of difference in arrangement of stacking bolts 16 fastening the rotor 1. In this Figure, the supply passage 74 is arranged so as to be within a width of the vapor passage 79. However, in the case where a sufficient flow sectional area can be secured, the short pipe 15 can be omitted by providing the supply passage 74 outside the width of the vapor passage 79.

In the vapor passage within the rotor, constructed as mentioned above, the vapor from the vapor supply port 45 at the end of the stubshaft into the interior of the rotor 1 flows in the supply passage 74 in the axial direction through the vapor passage 44 in the central hole of the stubshaft, the cavity 67 and the vapor passage 75, and it is branched into three flow systems in the course of axial flow.

The first flow system is a vapor line for cooling the second stage blades 52, and vapor is supplied from a vapor passage 78 to the second stage blades 52 through the cavity 63 and the vapor passage 57 to cool them, and then flowed into the cavity 62 through the vapor passage 56.

The second flow system is a vapor line for cooling the first stage blades 51, vapor is supplied from the vapor passage 76 to the first stage blades 51 through the cavity 61 and a vapor passage 54 to cool them, and then flowed into the cavity 62 through the vapor passage 55. The vapor joins the recovery vapor in the first vapor line and flows in the vapor passage 79 and the cavity 65 toward the recovery passage 72 at the rotor central portion.

The third flow system is a vapor line for cooling the outer peripheral portion of the compressor rotor 2, vapor is supplied from the vapor passage 77 to the cavity 23 at the outer peripheral portion of the compressor rotor 2 through the cavity 64 and the vapor passage 31 of the distant piece to cool it. After cooling the outer peripheral portion of the compressor rotor 2, the vapor reaches to the recovery passage 72 at the central portion of the turbine rotor through the cavity 24 of the side face of the compressor rotor disc 21 or 22, the central hole 25 of the same disc and the vapor passage 32 at the central portion of the distant piece, joins the vapor after cooling the blades in the recovery passage 72, and then is recovered from the vapor recovery port 46 out of the rotor through the vapor passage.

In the vapor passages as mentioned above, since first of all, the supply vapor of low temperature flows in the supply passage 74 formed so as to pass through the discs, the temperature of the disc joining portion 14 is kept to about the same temperature as the supply vapor of low temperature except for the joining portion forming vapor passage 79 for recovery vapor. Therefore, occurrence of thermal strain and thermal stress in the above-mentioned joining portion is reduced, the stability as a high speed rotator can be kept, and it is possible to smoothly transmit the rotation.

Further, since the recovery vapor flows in the recovery passage of the rotor central portion, most parts of each disc, which are at the more central side than the joining portion 14, are exposed to vapor of high temperature, whereby the temperature of the parts are raised to about the same as the temperature of the vapor. In the case of the above-mentioned gas turbine in which the temperature of a working gas is 1500° C., temperature rise of the vapor due to thermal load exceeds 200° C. However, supply of the vapor in which the temperature is lower (250° C.) by the temperature rise than an allowable temperature (usually 450° C.) of the disc can suppress the temperature of the rotor central portion to the allowable temperature or less.

Further, the maximum stress is caused in the central portion of the disc by centrifugal force. However, strain of the central portion caused by the thermal expansion relaxes the stress by keeping the temperature of the joining portion 14 low and making the temperature of only the central portion higher, so that the large advantage to reduce the centrifugal stress of the disc central portion can be attained.

Further, it is necessary to keep extremely low the temperature of the shaft at the bearing supporting the rotation. In the present invention, supply vapor of low temperature flows in the central hole of the stubshaft at an outer side of the recovery vapor, so that temperature rise caused by recovery of vapor can be limited to a minimum value.

On the other hand, since at least one of the side surfaces of the outer peripheral portion of each disc is cooled by supply vapor of low temperature, an average temperature of the outer peripheral portion of the disc becomes about an intermediate temperature (about 350° C.) of between the supply vapor and the recovery vapor, never goes beyond the recovery temperature even taking into consideration of a temperature distribution, and it is possible to suppress the temperature rise to the allowable temperature or less. Further, since extension of the outer periphery of the disc in the radial direction by thermal expansion can be minimized, gaps 91 at the tips of the blades and a seal gap of a labyrinth seal 92 are made small to contribute to an improvement of the gas turbine efficiency.

Further, by forming the vapor passages 31, 32 in the distant piece to construct the third vapor flow system, it is possible with a simple construction to cool the outer peripheral portion of the compressor rotor, jointly using the vapor system of the turbine rotor, and it is possible to raise the compression ratio with use of a material of a lower cost than that usually used and, which contributes to make the temperature of a working gas of a gas turbine higher.

Further, seal air 94 is supplied to the outer peripheral portion of the distant piece 3 to prevent the working gas of high temperature from flowing away from the gas path 85 through the gap 93. The air is extracted from the discharge portion of the compressor, so that the distant piece is heated in the same manner as in the outer peripheral portion of the compressor. However, the third vapor flow system has an effect to cool uniformly the distant piece too.

Figure 3:
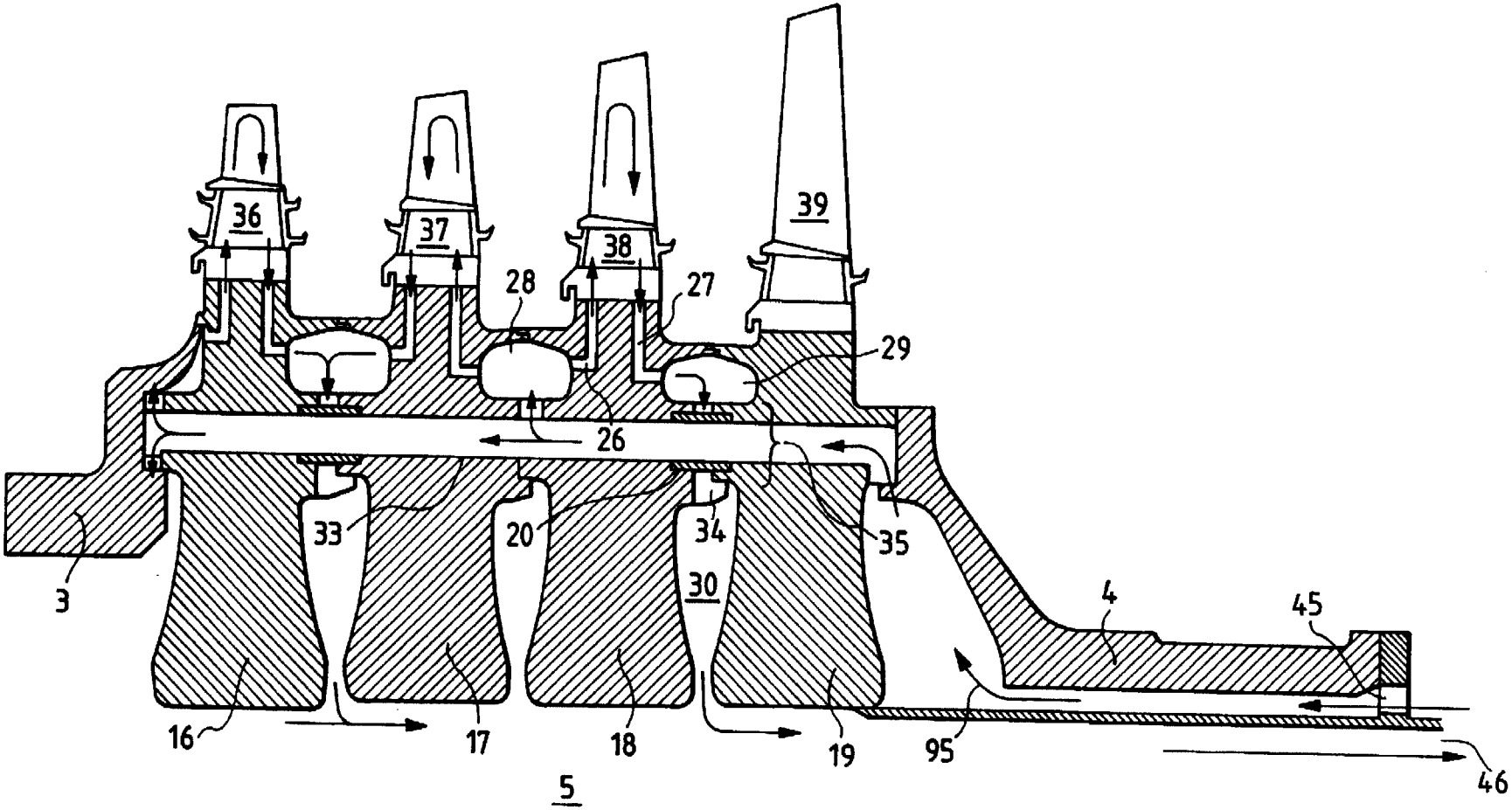
FIG. 3 is a sectional view of a vapor cooling type gas turbine of another embodiment of the present invention.

FIG. 3 shows another embodiment of the present invention. This embodiment is a gas turbine in which the rotor is formed in 4 stages, and the first to third stage blades are cooled with vapor.

A rotor is constructed of 4 discs 16, 17, 18 and 19, sandwiched by a distant piece 3 and a stubshaft 4 to fix them at the joining portion 35. Blades 36, 37, 38 and 39 are mounted on the outer periphery of the discs 16–19. The blades 36–38 have vapor passage in an interior thereof and are cooled.

In this case, also, a vapor supply passage 33 passing through the discs are formed at the joining portion 35, and the same vapor passages as the above-mentioned are formed in the first, second and final stage discs 16, 17 and 19. In the third disc 18 supporting blades 38 which are necessary to be cooled newly, vapor passages 26 and 27 are formed in the outer peripheral portion of the disc 18, a vapor passage 34 is formed with a short pipe 20 being provided in the joining portion 35, and cavities 29 and 30 are formed between the third stage disc and the fourth stage disc.

By constructing the above-mentioned vapor passages, vapor supplied from the vapor supply port 46 flows in the rotor along a course shown by an arrow 95, and as a fourth vapor cooling system, a vapor passage is formed for supplying the vapor from the cavity 28 to the blades and returning therefrom the vapor to the rotor central portion. That is, the vapor passage extends from the cavity 28 to the blades through a vapor passage 26, and returns therefrom to the rotor central portion through a vapor passage 27, a cavity 29, a vapor passage 34 and a cavity 30. The vapor joins vapor from other passages in the recovery passage and is recovered from the vapor recovery port 46 at the shaft end.

That is, in the fourth stage turbine rotor, also, vapor supply and recovery passages of the vapor cooling type gas turbine can be constructed, based on the same concept as in the third stage turbine rotor. Effects are attained of keeping of the stability in high speed rotation by making the temperature of the disc joining portion low, the relaxation of centrifugal stress due to thermal expansion at the central portion of the disc, reduction of temperature rise caused by recovery of high temperature vapor of the outer peripheral portion of the disc, etc.

Figure 4:
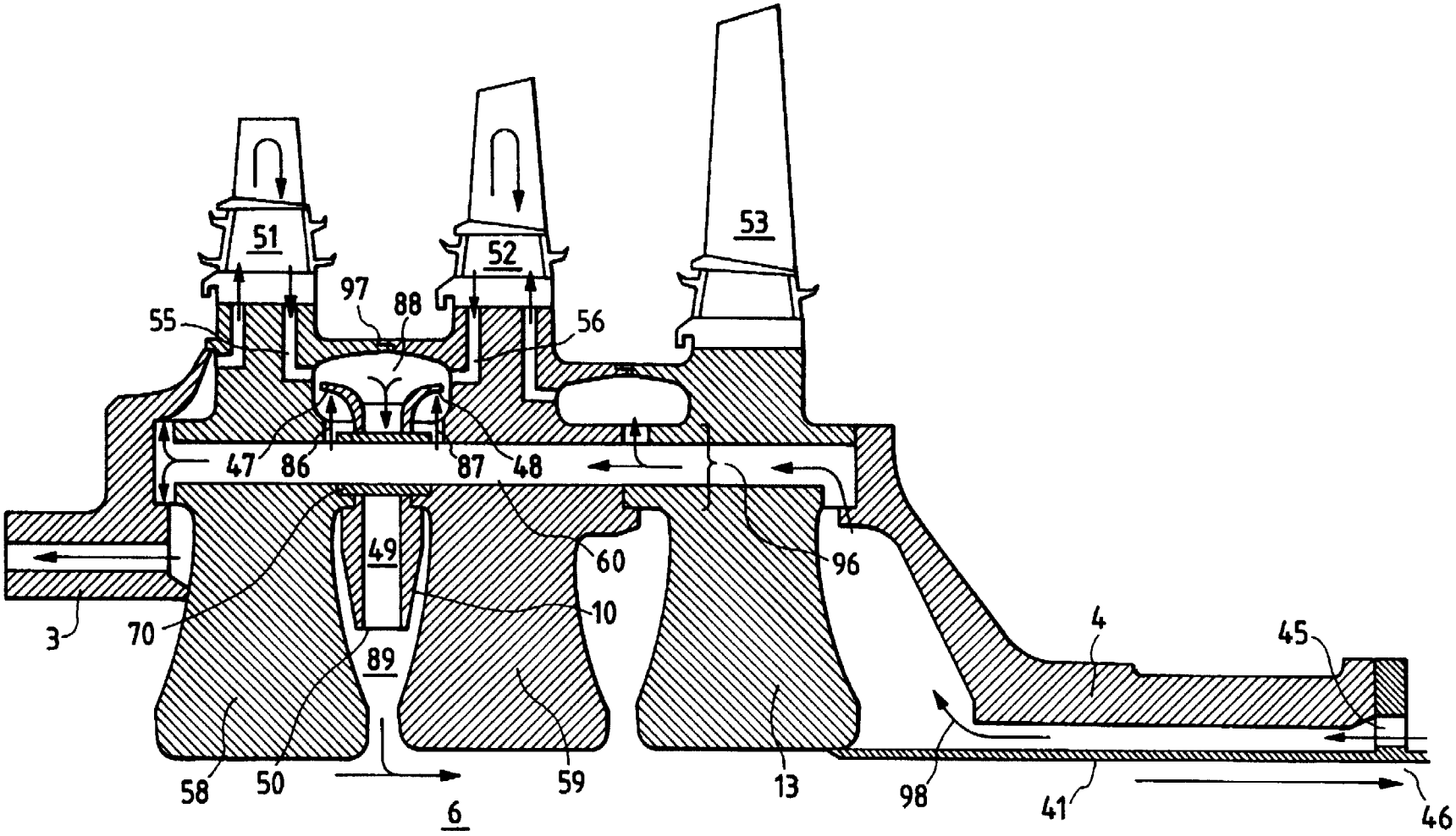

FIG. 4 shows another embodiment of the present invention in which the vapor recovery passages are further improved.

That is, a gas turbine rotor 6 is constructed by providing a spacer 10 between a first stage disc 58 and a second stage disc 59, the spacer 10 is contained in cavities 88, 89 formed between the first and second stage discs 58 and 59. A plurality of vapor passages 49 arranged in the radial direction are formed in the spacer 10, a short pipe 70 is provided in each of the plurality of vapor passages 49 so that the vapor passage 49 does not communicate with a vapor supply passage 60 formed so as to pass through the joining portion 96 of the disc and the spacer, and each vapor passage 49 has projecting portions 47 and 48 formed at its outer peripheral portion.

The vapor supplied from the supply port 45 at the shaft end and having cooled the blades 51 and 52 flows into the cavity 88 through vapor passages 55 and 56 in the outer peripheries of the discs 58, 59, and is recovered from the vapor recovery port 46 through the vapor passage 49 in the spacer 10 and the cavity 89.

Accordingly, since the disc joining portion 96 is not directly exposed to the recovery vapor of high temperature, the joining portion 96 can be kept lower and uniform in temperature. Further, providing the projecting portions 47 and 48, flows of the recovery vapor in the side surfaces of discs are bent so as to be separated from the side surfaces, so that heat transfer from the recovery vapor to the disc side surfaces is suppressed, whereby thermal stress is reduced.

Further, by forming the vapor passages 86, 87 communicating between the supply passage 60 and the cavity 88 at the joining portion of the disc and the spacer, a part of supply vapor of low temperature flows into the cavity 88 through the vapor passages 86, 87 and flows so as to creep on the side surfaces of the discs, so that an outer peripheral wall 97 in addition to the side surfaces is cooled. Therefore, the temperature rise of the outer peripheral portion of the discs is suppressed further and the temperature distribution also is made uniform, whereby the thermal stress caused by the vapor recovery is reduced further.

Further, since the temperature of the recovery vapor is lowered by mixing low temperature vapor into high temperature vapor, the means can be used effectively to prevent the temperature rise of the disc and thermal stress reduction in the case of the working gas of high temperature in particular by setting a proper mixing flow rate.

Further, a pumping power $Gr^2\omega$, wherein r represents rotation radius, $\omega$ angular speed and G, vapor flow rate, is necessary to supply vapor into the rotating blades. The power is recovered as rotation power of the rotor in the course in which the vapor after cooling flows toward the radially inner side. The recovered power is determined by an outflow radial position at an outlet 50 of the vapor passage 49, the larger the radius (the more inner the outflow radial position) is, the more the recovery power is. Therefore, the mounting of the spacer makes the above-mentioned flow out radial position small, so that the provision of the spacer has a large effect for reducing the vapor pumping power caused by the cooling.

Further, it is known that a large pressure loss in flow takes place in the course of a flow from free eddy current in the cavity to axial flow in the disc central hole. The pressure loss is influenced by strength of the eddy in the cavity. However, since the eddy is weakened by mounting the spacer to reduce the above-mentioned outflow radial position, the mounting of the spacer brings a large effect on the pressure loss reduction.

Further, in the above-mentioned embodiments, the case in which compressed air is used for producing the working gas of the gas turbine is explained. However, the same effect can be obtained as long as the blades are cooled with vapor even if the another working gas is used.

Another embodiment of the present invention is explained hereunder. In FIG. 5, an essential portion of a gas turbine of the embodiment is shown. Further, in this FIG. 5, an upper half of a closed vapor cooling type gas turbine in the case of a 4 stage turbine is shown. The gas turbine comprises a casing 501, a compressor 590 for generating compressed air, a combustor 503, and a turbine 591 having vanes 511 and blades 515.

A gas turbine rotor 505 is constructed of 4 discs 521, 522, 523 and 524, spacers 531, 532, 533 and a stubshaft 506, firmly joined as a high speed rotator at a joining portion 525. At a central portion of each disc, a central hole 526 is formed, and the blades 515 are mounted on the periphery. Further, a plurality of cavities 541–546 are formed between the structural members except for the above-mentioned joining portion. In this construction, one end of the rotor is rotatably supported by a bearing 507, the other end is connected to the compressor rotor 502 through a distant piece 508. Combustion gas of high temperature and high pressure produced in the combustor 503, using compressed air, flows in the gas path 504 while expanding, thereby to rotate the turbine rotor 505 to generate power.

For example, when the temperature of the combustion gas is 1500° C., the gas temperature is about 1250°–1300° C. at the moving blade inlet, about 950°–1000° C. at the second stage, which temperature goes far beyond an allowable temperature of the blade (85°–900° C. in usual material). Thermal loads at the first and the second stages when a 400 MW-equivalent gas turbine is taken become about 1.5% (about 6000 kW) of the output and 1.2% (5000 kW), respectively. Further, when a compression ratio of the compressor is made 25, a discharge temperature becomes about 500° C. The members from the high stage of the compressor to the distant piece 508 is exposed to the same temperature as above.

Here, in order to cool, using vapor, the first to third stage blades 515 and the compressor rotor 502, a vapor supply port 561 and a vapor recovery port 562 are formed at one end of the stubshaft 506. The central portion has a double tube structure. Supply vapor flows in the supply passage 563 at a central side and recovery vapor flows in the recovery passage 564 at an outer side. Further, in a cone portion, a recovery hole 565 extending from the joining portion 525 at the outer side to the above-mentioned recovery passage 564 at the central portion is formed. The inner walls of the recovery passage 564 and the recovery hole 565 are provided with heat resistors 570 and 571.

Further, supply slits 551, 552, 553 and a recovery slit 555 and a recovery hole 556 are formed in the joining portion of the turbine rotor and arranged in the peripheral direction. A heat conductive resistor 572 is provided in the recovery hole 556.

Further, a plurality of recovery holes 534 are provided in the spacer 531 in the radial direction, the inner end of each of which recovery holes communicates with the recovery hole 556 of the joining portion 525 and the side surface is provided with annular fins 535.

On the other hand, a cooling passage 557 is formed at the high pressure stage side of the compressor. The distant piece has a bore 558 formed in the central portion and a plurality of recovery holes 559 formed at the outer peripheral portion. The rotor central hole 526 of the turbine communicates with the cooling passage 557 of the compressor rotor through the bore 558, and an outlet of the cooling passage 557 communicates with the supply slit 551 of the turbine rotor 505 through the recovery hole 559, the rotation passages 553 and the cavities 545–548. The vapor having passed through the cooling passage 557 and the supply slit 551 is recovered through the recovery hole 565 of the turbine rotor.

FIG. 6 shows a section taken along a line 6—6 of FIG. 5. Each of heat conduction resistors 570, 571, 572 is formed in a tubular shape, a small gap 575 is formed between an outer wall 573 of the tube and the inner wall 574 of the recovery hole.

In the vapor passage constructed as mentioned above in the rotor, vapor supplied from the vapor inlet 561 at the end of the stubshaft into the interior of the rotor 505 has part thereof branched in the course of flow in the central hole 526, as shown by a flow line 580, and then it is supplied to the second and third stage blades through the cavity 542, the supply slits 551, 552 and the cavities 548, 549. The remaining vapor flows in the cooling passage 557 of the compressor rotor through the bore 558, and then it is supplied to the first stage blades through the recovery passage 559 of the distant piece 508 and the cavity 545.

On the other hand, the vapor after cooling the first and second stage blades flows from the cavity 546 formed between the first stage disc 521 and the spacer 531 and the cavity 547 formed between the this spacer and the disc 522 into the recovery hole 534 of this spacer, and the vapor is introduced into the recovery hole 556 of the joining portion. Further, the vapor after cooling the third stage blades is introduced from the cavity 550 formed between the third stage disc 523 and the spacer 533 into the recovery hole 556, joins the vapor for the first and second stage blades, and is recovered out of the rotor through the recovery hole 565 of the stubshaft and the recovery passage 564 in the shaft central hole. First of all, paying attention to the inner peripheral portion of each disc on a more inner side than the joining portion 525 in view of the above-mentioned vapor flow, the inner wall of the central hole 526 of one disc is in substantially the same condition as in any other discs with respect to heat conduction. On the other hand, a forcible flow region (the cavity 542) and a stagnant region (the cavities 541, 543, 544) are formed on the sides faces of the disc. However, taking into consideration the existence of a large speed difference between a swirling component of vapor flow in the central hole 526 and flow along the disc side surface, occurrence of eddies due to impingement of vapor flow on the disc wall in the stagnant region, etc. even each disc side surface is in about the same condition, with respect to the thermal conductivity, as in the inner wall of the central hole. Therefore, the temperature of the inner peripheral portions of the discs is about the same as the temperature of the supply vapor which is distributed symmetrically with respect to left and right. Although centrifugal stress is large, thermal stress only a little.

Next, the outer peripheral side of each of the first to third stage discs is cooled with supply vapor at one side, and cooled in the atmosphere of heating vapor at the other side. As for the third stage disc 523 of those discs, since a flow rate of vapor is small, the heat transfer coefficient is relatively small, and since the disc is thick, a temperature gradient between left and right is small and the thermal stress only a little. On the contrary, as for the first and second stage discs 521, 522, a large cool source and a heat source are applied to their side surfaces, so that a temperature difference of 100° C. or more takes place. However, since the centrifugal force caused in this part is small, the temperature gradient and the centrifugal stress can be suppressed by changing the thickness of the structural member.

Further, the thermal stress is reduced further by narrowing heat in a conductive area in the heat source side by the annular fins 535, and by further forming a low temperature atmosphere by extracting a small amount of supply vapor from the bypass hole 536. This brings an effect of raising the temperature of the disc outer peripheral end in which the blades are mounted. The extraction of supply vapor dilutes recovery vapor to lower the temperature and acts effectively to reduce the thermal stress of the joining portion, which is described next.

Further, the joining portion in the middle portion of the rotor is heated by the recovery vapor from the inner wall of the recovery hole. However, the periphery of the joining portion is surrounded mainly by supply vapor of low temperature and the heat conductive area of the periphery is much larger than the recover hole.

Further, in the gap 574 of the heat conduction resistor 572 as shown in FIG. 6, the heat transfer (when the gap is 0.1 mm, an equivalent heat tranfer coefficiet is about 100 kcal/m$^2$ h° C.) is effected by heat conduction of vapor, so that a heat transfer amount is reduced greatly as compared with the case (when a flow rate of recovery vapor is 80 m/s) where the heat conduction resistor is not provided. Therefore, as large a heat gradient is not formed even in the rotor joining portion, and occurrence of thermal stress is only a little. A surrounding of the recovery hole 565 of the stubshaft also is in a similar atmosphere to that of the above-mentioned joining portion, however, this part has a small centrifugal force applied thereto, so that a problem which may occur can be solved by providing any suitable shape.

The outer periphery of the spacer 531 is exposed to the most sever atmosphere of recovery vapor of high temperature, and the temperature becomes high. However, since the outer peripheral wall is cooled by seal air of wheel space shown by a flow line 581, and a part of the side surface thereof is cooled by the extraction air from the bypass hole 536, it never exceeds an allowable temperature of rotor material. Further, with respect to the strength, since the centrifugal force applied thereto is small by a force applied by supporting the blades and heat conductive circumference on both sides are formed substantially symmetrical, the generated thermal stress is relatively small.

On the other hand, in the outer periphery of the compressor rotor, discharge air of the compressor leaked from the labyrinth seal flows to the wheel space 585 of the side of the disc 521, as shown by a flow line 582. Therefore, the distant piece also is heated in addition to the compressor rotor. However, not only the rotor but also the distant piece is cooled by bypassing the vapor for the blades through the cooling passage 557 in the compressor rotor along an arrow 583, so that temperature raise can be suppressed. Further, there is the concern that the vapor is heated and the supply vapor temperature to the blades is raised. However, since the heat capacity of vapor is large as compared with thermal load, the temperature rise is retained within 10° C. and it does not become a large problem.

FIG. 7 shows another embodiment of the present invention. In this embodiment, the construction of the turbine rotor is the same as the previous embodiment, however, the compressor rotor and distant piece cooling passage are different. Namely, in the interior of the compressor rotor, a cooling passage including rotation flow passage 566 in a radial outer direction is formed, and inlet port and outlet port at the both ends of the cooling passage are opened to the bore 568 of the distant piece 567.

The vapor flowing from the central hole 526 of the turbine rotor into the bore is very small in rotational speed component, so that the pressure of central portion and the pressure of the outer periphery side inside the bore 568 are approximately equal to each other. On the other hand, in the cooling passage of the compressor rotor, since a flow toward the outside is formed by pumping operation of the rotation passage 566 to flow out on the bore side, recirculation flows shown by flow line 584 are formed.

Since the recirculation vapor is always replaced by supply vapor in the bore, the compressor rotor is cooled with the recirculation vapor, and the distant piece 567 is cooled with vapor within the bore. In this case, since a vapor flow rate is small as compared with the above-mentioned means, a cooling ability is small, but since it is unnecessary to form a recovery hole in the distant piece, the construction can be made simple. Pressure loss in the vapor passage also can be reduced.

FIG. 8 shows another embodiment of the recovery system in the shaft portion. In this case, vapor after cooling is recovered through a recovery pipe 591 without providing a recovery hole in the stubshaft 590. The same effect also can be attained by this construction.

In the embodiments as explained above, gas turbines are shown which are of the type wherein both the turbine blades and the compressor rotor are cooled. However, in some kinds of gas turbines, the compressor rotor may be cooled with compressed air of a middle stage. In this case, in order to avoid mixing of the air into the vapor, a partition is provided in the distant piece. Further, it can be taken to close the central portion of the first stage disc to form a supply hole in the joining portion, and supply vapor for the first stage blades through this supply hole. In any cases, substantially the same effect can be attained of cooling the turbine rotor side.

Further, the above explanation is taken so that all the discs constructing the turbine rotor have the central holes bored. However, even in the case where the first stage disc does not have such a central hole, a vapor recovery system having a vapor recovery function can be constructed by making use of a cavity between the first stage disc and the second stage disc as a vapor supply passage for the first stage blades.

As mentioned above, in this gas turbine, it is possible to recover the vapor after cooling the blades by solving various problems which may be caused in recovery of high temperature vapor, and in addition thereto it is possible to cool the compressor rotor also, whereby the working gas can be raised further to a high temperature. Therefore, vapor-cooled gas turbines suitable to improve the efficiency can be obtained. Further, by suppressing the temperature of the rotor to a low temperature, reliability as a high speed rotator can be secured, time from starting of the turbine to a rated operation can be reduced, and thermal stress at time of other than the rated operation time also can be reduced. Further, cost reduction also is possible by using a conventional rotor material.

What is claimed is:

1. A gas turbine having a cooling system which cools the blades with vapor, wherein said cooling system comprises a supply passage for supplying vapor to at least first and second stage blades and a vapor recovery passage for recovering the vapor supplied to said at least first and second stage blades, said vapor recovery passage including a first passage portion formed in a joining portion joining a disc and an adjacent disc of a rotor of said gas turbine and a cavity formed between first and second stage discs and fluidly connected to said first passage portion.

2. A gas turbine comprising a compressor and a gas turbine connected to said compressor through a distant piece, wherein said compressor has a compressor rotor having a cooling passage in which cooling steam flows, and said distant piece has a steam supply line in which steam flows into said cooling passage and a steam recovery line in which the steam having passed through said cooling passage flows.

3. A gas turbine in which the blades are cooled with vapor, wherein a vapor passage for recovering vapor having cooled said blades comprises a cavity between discs of a rotor of said gas turbine and a first passage portion formed in a spacer portion between said discs and fluidly connected to said cavity so as to flow the vapor from said blades towards an inner side of said rotor.

4. A gas turbine according to claim 3, wherein said spacer portion has a projecting portion for guiding vapor to be recovered into said vapor passage.

5. A gas turbine according to claim 4, further including a supply passage formed in a portion joining said discs for supplying vapor to the blades, wherein side surfaces of said discs are cooled with a part of the vapor in said supply passage.

6. A gas turbine constructed so as to cool the blades arranged in an outer peripheral portion of a rotor, using vapor, wherein a supply passage for supplying vapor to said blades and a recovery passage for recovering vapor from said blades are provided inside said rotor, said supply passage being formed of a hole provided at a rotor axis and a cavity portion between members, and said recovery passage being formed of a hole formed axially in a cavity portion between members forming said rotor.

7. A gas turbine according to claim 6, wherein a heat resistor is provided on a wall surface of said recovery passage.

8. A gas turbine constructed so as to cool the blades arranged in an outer peripheral portion of a rotor, using vapor, wherein a supply passage for supplying vapor to said blades and a recovery passage for recovering vapor from said blades are provided inside said rotor, said supply passage being formed of a hole provided in discs and a cavity portion between members, and said recovery passage being formed of a recovery hole formed in a disc joining portion.

9. A gas turbine which is constructed so as to be directly connected to a compressor and in which blades of the turbine are cooled with vapor, wherein a cooling passage is formed inside a rotor of said compressor, a supply passage for supplying vapor to said turbine blades is comprised of a hole provided at the axis of said compressor rotor, a cooling passage formed inside said compressor rotor, and a bore portion formed in a distant piece connecting said compressor rotor and a turbine rotor, and a recovery passage is formed of a recovery hole provided in a disc joining portion.

10. A cooling apparatus for gas turbine blades, which cools the blades arranged in an outer peripheral portion of a rotor with vapor, wherein a supply passage for supplying vapor to said blades and a recovery passage for recovering vapor from said blades are provided inside said rotor, said supply passage being formed of a hole provided at a rotor axis and a cavity portion between members forming said rotor, and said recovery passage being formed of a hole formed axially in a connecting portion connecting said members and a cavity portion between members forming said rotor.

11. A cooling apparatus for gas turbine blades, which cools the blades arranged in a disc outer peripheral portion of a rotor with vapor, wherein a supply passage for supplying vapor to said blades and a recovery passage for recovering vapor from said blades are provided inside said rotor, said supply passage being formed of a central hole provided in said discs and a cavity portion between members, and said recovery passage including a recovery hole axially formed in a disc joining portion.

12. A cooling method for gas turbine blades, which cools the blades arranged in an outer peripheral portion of a rotor with vapor, wherein vapor supply to and vapor recovery from said blades are effected through flow passages, the vapor supply is effected from a rotor axis side and the vapor recovery is effected in a more outer side than a position of the vapor supply, the vapor cooling said blades being recovered outside the rotor.

13. A gas turbine having a cooling system which cools the blades with vapor, wherein said cooling system comprises a supply system for supplying vapor to said blades and a recovery system for recovering vapor from said blades, said supply system including a supply passage, and said recovery system including a recovery passage spaced outwardly from said supply passage, the vapor being recovered from a turbine rotor through said vapor recovery system.

14. A gas turbine having a cooling system which cools the blades with vapor, wherein said cooling system comprises a supply port formed at a rotor axial end of said gas turbine for supplying vapor and a recovery port formed at a rotor axial end of said gas turbine for recovering vapor from said blades out of said rotor, said supply port being positioned at a position closer to the rotor axis than said recovery port, and said supply port is fluidly communicated with said recovery port through a vapor passage in which said blades to be cooled are disposed.

* * * * *